United States Patent [19]

Kozulla

[11] 4,106,689

[45] Aug. 15, 1978

[54] DISPOSABLE CENTRIFUGAL SEPARATOR

[75] Inventor: Robert E. Kozulla, Willowick, Ohio

[73] Assignee: The Weatherhead Company, Cleveland, Ohio

[21] Appl. No.: 785,124

[22] Filed: Apr. 4, 1977

[51] Int. Cl.[2] ..... B04B 9/00

[52] U.S. Cl. ..... 233/23 R

[58] Field of Search ..... 233/23 R, 24, 2, 27, 233/1 R; 210/DIG. 17

[56] References Cited

U.S. PATENT DOCUMENTS

| | | | |
|---|---|---|---|
| 1,714,658 | 5/1929 | Carter | 233/24 |
| 3,432,091 | 3/1969 | Beazley | 233/23 R |
| 3,762,633 | 10/1973 | Ishii et al. | 233/23 R |
| 3,784,092 | 1/1974 | Gibson | 233/23 R |
| 3,879,294 | 4/1975 | Ellis et al. | 233/2 |
| 3,912,633 | 10/1975 | Delaney | 210/DIG. 17 |

FOREIGN PATENT DOCUMENTS

| | | | |
|---|---|---|---|
| 2,205,089 | 8/1972 | Fed. Rep. of Germany | 233/23 R |

*Primary Examiner*—George H. Krizmanich

*Attorney, Agent, or Firm*—McNenny, Pearne, Gordon, Gail, Dickinson & Schiller

[57] ABSTRACT

A disposable, centrifugal separator for separating contaminants from contaminated oil is disclosed. The centrifugal separator has a shroud which defines a first chamber and has a hollow rotor rotatably mounted in the first chamber and defining a second chamber. Oil under pressure is admitted to the second chamber through concentrically arranged tubes or spindles and past a low pressure shut-off valve. The oil flows into the first chamber through tangential reaction nozzles in the rotor to cause contaminants to migrate toward the sidewall of the second chamber under the influence of centrifugal force. The shroud and rotor are permanently closed so that the entire assembly may be discarded when a significant amount of contaminants has been deposited on the sidewall of the second chamber.

8 Claims, 1 Drawing Figure

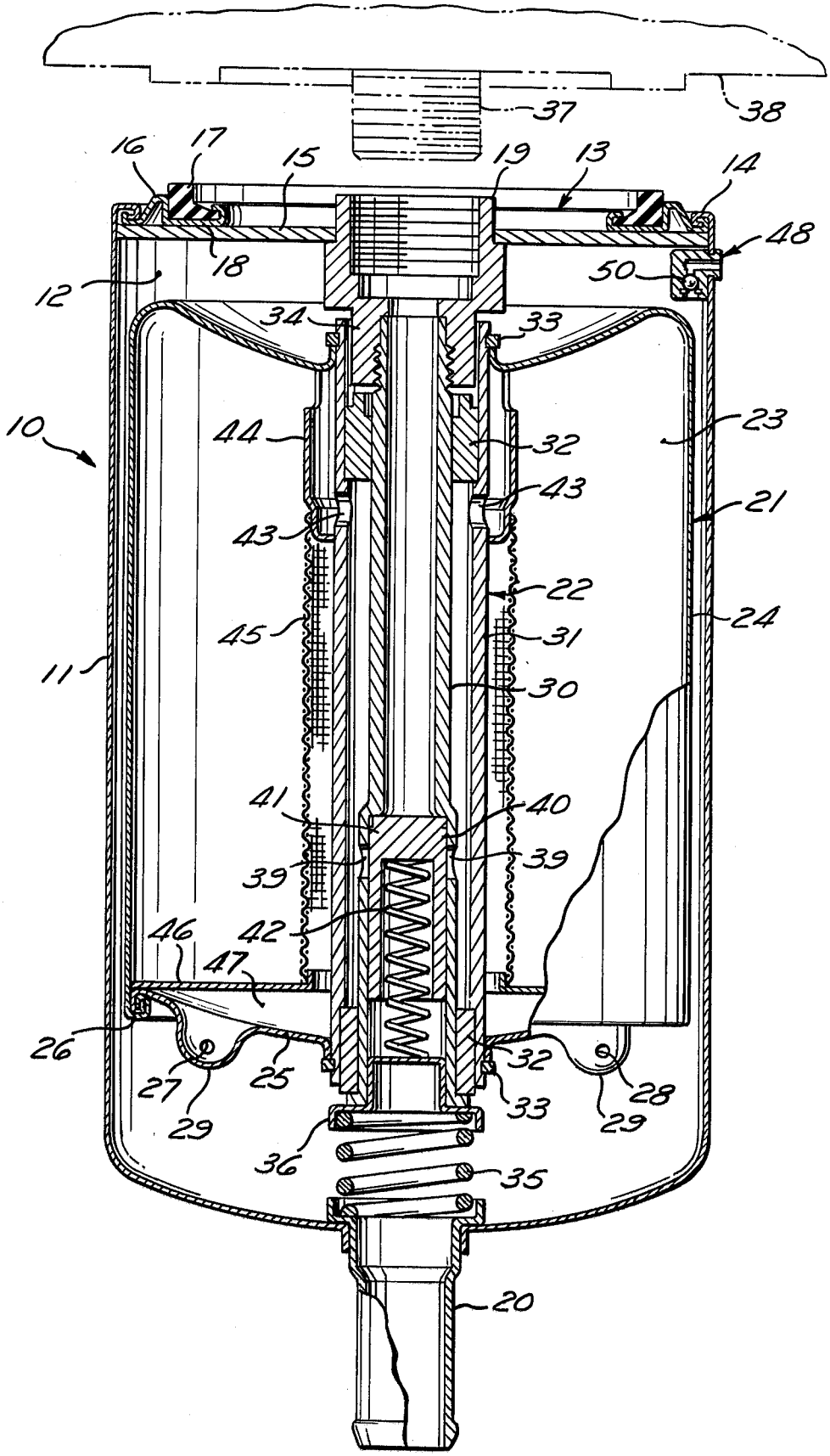
37
38
16
17
15
19
13
14
48
18
50
12
34
33
10
44
32
23
43
21
43
22
45
24
31
11
30
41
40
39
39
42
46
47
26
32
27
25
28
33
29
29
36
35
20

DISPOSABLE CENTRIFUGAL SEPARATOR

Conventional fluid filters, such as oil filters, are basically mechancial strainers which include a filter element having pores which trap and segregate dirt from the fluid. Since the flow through the filter is a function of the pore size, filter flow will decrease as the filter pack becomes clogged with dirt. Since the filtration system must remove dirt at the same rate at which it enters the oil, a clogged conventional pack cannot process enough oil to keep the dirt level of the oil at a satisfactory level. A further disadvantage of some mechanical strainer type filters is that they tend to remove oil additives. Furthermore, the additives may be depleted to some extent by acting upon trapped dirt in the filter and are rendered ineffective for their intended purpose on a working surface in an engine.

Prior art centrifugal filters have been proposed which do not act as mechanical strainers but, rather, remove contaminants from a fluid by centrifuging. For example, such a filter is shown in U.S. Pat. No. C 3,432,091, granted to Beazley. In the Beazley patent, there is illustrated a hollow rotor which is rotatably mounted on a spindle. The spindle has an axial passageway which conducts oil into the interior of the rotor. Tangentially directed outlet ports are provided in the rotor so that the rotor is rotated upon issuance of the fluid therefrom. Solids such as dirt are centrifuged to the sidewalls of the rotor and the dirt may be later removed by disassembling the rotor and scraping the filter cake from the sidewalls.

Such centrifugal filters have oil inlets and outlets through the base of the filter, since access to the rotor for cleaning purposes is provided by removing a shroud cover and by then removing the rotor from the spindle. This necessitates a relatively heavy and elaborately machined base casting for the centrifugal separator and separator itself is intended to be a permanent installation which is periodically cleaned to remove the sludge buildup.

SUMMARY OF THE INVENTION

This invention relates to a centrifugal separator which is inexpensive and may be disposed of after use rather than disassembled for cleaning. An inlet is provided at one end of the separator and an axially aligned outlet is provided at the other end of the separator so that the outward appearance of the device is very similar to a conventional automotive spin-on crankcase canister filter. It is intended that the filter be replaced every 50,000 miles; therefore, its construction need not be as rugged or expensive as conventional centrifugal separators.

According to this invention, a closed shroud means defines a first chamber and a vertically extending spindle is mounted within the shroud and has a permanently sealed, hollow rotor rotatably mounted thereon. The rotor defines a second chamber for receiving contaminated fluids to be separated and the spindle comprises an inner hollow tube and an outer hollow tube surrounding and spaced from the inner tube. An inlet port is provided at one end of the inner tube for admitting contaminated fluids and an outlet port is provided adjacent the other end of the inner tube for conducting the contaminated fluids to the space between the inner and outer tubes. There is further provided an outlet port adjacent one end of the outer tube at an end of the tube remote from the other end of the inner tube and communicating with the second chamber. A screen surrounds the outer tube and with the outer tube defines a third chamber. A baffle separates the outlet port in the outer tube from direct communication with the third chamber. The rotor is rotated cause contaminants in contaminated fluids in the second chamber to migrate toward a sidewall of the second chamber under the influence of centrifugal force and to be separated from the contaminated fluids. The rotor is rotated by tangentially mounted outlet ports on the rotor in fluid communication with the third chamber to cause the rotor to rotate upon discharge of fluid from the second chamber to the first chamber.

There is provided a bleeder valve in the first chamber to allow adequate drainage. The drainage must pass through an outlet fitting which is smaller in flow area than the drain of many prior art arrangements. The bleeder valve provides an atmospheric reference between the inside and the outside of the first chamber, thereby venting the suction created during drainage.

BRIEF DESCRIPTION OF THE DRAWING

The drawing illustrates a centrifugal filter according to this invention, partly in section, and a crankcase mounting fitting adapted to receive the filter.

DETAILED DESCRIPTION OF THE INVENTION

Referring now to the figure, there is illustrated a centrifugal separator 10 having a sealed shroud 11 which defines a first chamber 12. The shroud 11 comprises a drawn sheet metal can having a lid 13 joined to the can by a conventional can-type rolled seam 14. The lid 13 includes a relatively thick support disc 15 and a relatively thin gauge ring 16 welded to the support disc 15. The ring 16 is shaped to retain a sealing gasket 17 in a rolled channel 18. An axially aligned inlet fitting 19 extends through and is permanently assoicated with the support disc 15. An axially aligned outlet fitting 20 is permanently affixed to and extends through the other end of the shroud 11. The shroud 11 also has attached to it a bleed valve 48 having a light ball 50 which remains off its seat by gravity during the filter operation. If for some reason the outlet flow is throttled, the first chamber will fill with oil, thereby forcing the ball to its seat and preventing oil from leaking to atmosphere. It should be appreciated that the style and configuration of the inlet and outlet fittings 19 and 20 are subject to particular mounting requirements for the separator.

A hollow rotor 21 is rotatably mounted on a spindle assembly 22. The rotor 21 defines a second chamber 23 and comprises a can 24 which is closed by a base 25 joined to the can 24 by a rolled seam 26. Tangential and oppositely directed outlet ports 27 and 28 are formed in the base 25 in depressions 29.

The spindle assembly 22 comprises an inner tube 30 threaded into the inlet fitting 19 and a concentrically arranged outer tube 31 mounted for the rotation relative to the inner tube 30 by bearings 32. The rotor assembly 21 is fixed to the rotatable outer tube 31 by snap rings 33. The rotor assembly 21 and the spindle assembly 22 are supported by the inlet fitting 19 which has a neck 34 extending into the outer tube 31 and by a heavy spring 35 which has a thrust pad 36 projecting into the inner tube 30. The spring 35 permits fluid access from the first chamber 12 to the outlet fitting 20.

Oil enters the inlet fitting 19 from a fitting 37 on a crankcase 38 and flows to an outlet port 39 in the tube 30. The outlet port 39 is normally closed by a check valve 40 which comprises a spool 41 slidable in the inner tube 30 to a normally closed position across the port 39 and held in that position by a spring 42. At a predetermined pressure within the tube 30, the spool slides against the bias of the spring 42 to open the port 39. Thus, during idling or start-up conditions when the oil pressure is not high, the separator 10 will be bypassed. Oil issuing from the outlet port 39 flows through a space between the inner and outer tubes and through outlet ports 43 in the outer tube. There is provided a baffle 44 around the outlet ports 43 to direct oil into the second chamber 23. The oil egresses from the second chamber 23 to the first chamber 12 through the reaction nozzles 27 and 28. In order to reach the reaction nozzles 27 and 28, the oil must pass through a cylindrical screen 45, which surrounds the outer tube and which, with the baffle 44 and an annular plate 46, defines a third chamber 47. Desirably, the screen 45 has a mesh which is finer than the nozzle openings 27 and 28, so that those openings will not be plugged by any large particles which may tend to migrate to the third chamber 47. Oil is expelled from the second chamber through the tangentially mounted ports 27 and 28, and, since those ports are oppositely directed, they cause the rotor assembly 21 to rotate according to the principle of Hero's engine.

As the rotor assembly 21 rotates, suspended solids migrate to and are retained at the sidewall of the rotor with a force which is dependent upon the running oil pressure of the engine. In time, the dirt particles and sludge form a rubber mass at the rotor sidewall. After a predetermined number of miles, this mass will accumulate until the entire separator 10 must be replaced.

While the invention has been described in connection with specific embodiments thereof, it is to be clearly understood that this is done only by way of example, and not as a limitation to the scope of the invention as set forth in the objects thereof and in the appended claims.

What is claimed is:

1. In a centrifugal separator for separating contaminants from contaminated fluids and being disposable by virtue of its economical construction, comprising shroud means having ends and intermediate sides defining a first chamber, vertically extending spindle within said shroud means and having a hollow rotor rotatably mounted thereon, said hollow rotor defining a second chamber for receiving contaminated fluids to be separated, inlet port means at one end of said spindle and shroud means, passage means through said spindle to said second chamber, means to rotate said rotor and thereby cause contaminants in contaminated fluids within said second chamber to migrate toward a sidewall of said second chamber under the influence of centrifugal force and to be separated from such contaminated fluids, said means to rotate said rotor comprising tangentially mounted outlet port means on said rotor in fluid communication with said second chamber to cause said rotor to rotate upon discharge of fluid from said second chamber to said first chamber, outlet port means from said first chamber, in combination therewith the improvement wherein said shroud is a permanently closed assembly substantially fully defining said first chamber with its sides and ends, said inlet port means at said one end of said spindle being axially aligned with the axis of said spindle, said inlet port including attaching means adapted to releasably attach said inlet port to a fitting on a crankcase, said attaching means being permanently fixed to said shroud means, said attaching means of said inlet port being constructed and arranged to be capable of providing substantially the sole support of said separator on said crankcase whereby said separator is readily removed from said crankcase by release therefrom of said attaching means, and said outlet port means being at the other end of said shroud means.

2. The improvement according to claim 1, therein said outlet port means is axially aligned with said inlet port means.

3. The improvement according to claim 1, wherein there is provided a sealing ring on said shroud surrounding said inlet port and adapted to form a seal against a crankcase.

4. A disposable cenrifugal separator for separating contaminants from contaminated fluids comprising shroud means defining a first chamber, a vertically extending spindle within said shroud means and having a hollow rotor rotatably mounted thereon, said hollow rotor defining a second chamber for receiving contaminated fluids to be separated, said spindle comprising an inner hollow tube and an outer hollow tube surrounding and spaced from said inner tube, an inlet port at one end of said inner tube for admitting contaminated fluids, a first outlet port adjacent the other end of said inner tube for conducting the contaminated fluids to the space between the inner and outer tubes, a second outlet port adjacent one end of said outer tube at an end of said tube remote from said other end of said inner tube and communicating with said second chamber, screen means surrounding said outer tube and with said outer tube defining a third chamber within said second chamber, baffle means separating said second outlet port from direct communication with said third chamber, means to rotate said rotor and thereby cause contaminants in contaminated fluids within said second chamber to migrate toward a sidewall of said second chamber under the influence of centrifugal force and to be separated from such contaminated fluids, said means to rotate said rotor comprising tangentially mounted outlet port means on said rotor in fluid communication between said third and first chambers to cause said rotor to rotate upon discharge of fluid from said third chamber to said first chamber, and a third outlet port from said first chamber at an end of said shroud opposite said inlet port.

5. A centrifugal separator as set forth in claim 4, wherein said first and second chambers are permanently sealed.

6. A centrifugal separator according to claim 4, wherein a pressure-responsive valve is provided between the inlet and outlet ports of said inner tube and is openable upon the attainment of a predetermined pressure.

7. A centrifugal separator according to claim 6, wherein said pressure-responsive valve comprises a valve spool slidable within said inner tube and spring-biased to a position blocking the outlet port of said inner tube in the absence of said predetermined pressure.

8. A centrifugal separator according to claim 4, wherein said inlet port at said one end of said inner tube is axially aligned with the third outlet port from said first chamber.

* * * * *